US007536758B2

(12) United States Patent
Meager

(10) Patent No.: US 7,536,758 B2
(45) **Date of Patent: *May 26, 2009**

(54) DEVICE FOR CREATING A SEAL BETWEEN FABRICS OR OTHER MATERIALS

(75) Inventor: Ben Meager, Kenmore, WA (US)

(73) Assignee: Gore Enterprise Holdings, Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/803,834

(22) Filed: Mar. 17, 2004

(65) Prior Publication Data

US 2004/0187273 A1 Sep. 30, 2004

Related U.S. Application Data

(63) Continuation of application No. 10/135,881, filed on Apr. 29, 2002, now Pat. No. 6,721,999.

(60) Provisional application No. 60/287,938, filed on Apr. 30, 2001.

(51) Int. Cl.
*A44B 19/00* (2006.01)

(52) U.S. Cl. ..... 24/437; 24/385; 383/60; 383/64

(58) Field of Classification Search ..... 24/399, 24/400, 415, 417, 427, 429, 433, 434, 436, 24/585.1; 383/63–66, 61.2, 107, 119
See application file for complete search history.

(56) References Cited

U.S. PATENT DOCUMENTS 1,703,712 A 2/1929 Aud ..... 383/64

(Continued)

FOREIGN PATENT DOCUMENTS

CH 287845 4/1953

(Continued)

OTHER PUBLICATIONS

Notification of Transmittal of the International Search Report or the Declaration dated Aug. 5, 2002 for International Patent Application No. PCT/US02/13558.

(Continued)

*Primary Examiner*—Jack W. Lavinder
(74) *Attorney, Agent, or Firm*—James Arnold, Jr.

(57) ABSTRACT

Disclosed is a device for creating a seal which includes an upper seal member, a lower seal member, and a slider, wherein mating surfaces of the upper and lower seal members interlock. A lifting rib on the slider cooperates with a lifting wing on the upper seal member and a closure bar cooperates with a closure bar groove of the lower seal member. By moving the slider in one direction, the lifting rib lifts the upper seal member from its interlocking relationship with the lower seal member. Moving the slider in the opposite direction causes the upper and lower seal members to interlock. Also disclosed is a seal device which includes upper and lower seal members and a cooperating slider and plug. Each of the slider and plug cooperate with first and second mating surfaces of the upper and lower seal members. In addition, the slider and plug have an exterior tongue and groove portion which cooperate to interlock the slider and the plug.

4 Claims, 10 Drawing Sheets

U.S. PATENT DOCUMENTS

| | | | | | |
|---|---|---|---|---|---|
| 1,706,097 | A | | 3/1929 | Aud | |
| 1,719,856 | A | | 7/1929 | Sipe | 24/400 |
| 1,887,741 | A | | 11/1932 | Trotter | |
| 1,959,318 | A | | 5/1934 | Sundback | 24/205 |
| 2,217,571 | A | | 10/1940 | Süsskind | 24/205 |
| 2,263,481 | A | | 11/1941 | Austin | 24/434 |
| 2,353,858 | A | | 7/1944 | Tedesco | 24/206 |
| 2,355,816 | A | | 8/1944 | Mömer | 24/206 |
| 2,491,524 | A | | 12/1949 | Siple | 24/207 |
| 2,507,445 | A | | 5/1950 | Krueger | |
| 2,613,421 | A | * | 10/1952 | Madsen | 24/399 |
| 2,652,611 | A | | 9/1953 | Jaster | 24/201 |
| 2,665,457 | A | | 1/1954 | Bosomworth et al. | 24/201 |
| 2,696,032 | A | | 12/1954 | Sander | 24/201 |
| 2,777,181 | A | | 1/1957 | Morner | 24/201 |
| 2,794,227 | A | | 6/1957 | Dorman | 24/201 |
| 2,810,944 | A | * | 10/1957 | Sander | 24/400 |
| 2,869,207 | A | | 1/1959 | Bernstein | 24/201 |
| 2,871,539 | A | | 2/1959 | Swan | 24/201 |
| 2,889,605 | A | | 6/1959 | Morin | 24/205 |
| 2,909,822 | A | | 10/1959 | Bottl et al. | 24/201 |
| 2,978,769 | A | | 4/1961 | Harrah | 24/201 |
| 3,153,269 | A | | 10/1964 | Berry | 24/201 |
| 3,203,062 | A | | 8/1965 | Ausnit | 24/201 |
| 3,259,951 | A | | 7/1966 | Zimmerman | 24/201 |
| 3,309,746 | A | | 3/1967 | Carlite | 24/205.11 |
| 3,325,084 | A | | 6/1967 | Ausnit | 229/77 |
| 3,338,285 | A | | 8/1967 | Jaster | 150/3 |
| 3,426,396 | A | | 2/1968 | Laguerre | 24/201 |
| 3,490,109 | A | | 1/1970 | Heimberger | 24/205.1 |
| 3,579,747 | A | | 5/1971 | Hawley | 24/201 |
| 3,591,914 | A | | 7/1971 | Heimberger | 29/408 |
| 3,660,875 | A | | 5/1972 | Gutman | 24/201 |
| 3,914,827 | A | | 10/1975 | Brown et al. | 24/205 |
| 3,959,856 | A | | 6/1976 | Ausnit | 24/201 |
| 4,112,150 | A | | 9/1978 | Brown et al. | 427/284 |
| 4,137,608 | A | | 2/1979 | Moertel | 24/205.11 |
| 4,199,845 | A | | 4/1980 | Ausnit | 24/291 |
| 4,262,395 | A | | 4/1981 | Kosky | 24/201 |
| 4,756,061 | A | | 7/1988 | Jones et al. | 24/433 |
| 4,890,935 | A | | 1/1990 | Ausnit et al. | 383/59 |
| 4,905,694 | A | | 3/1990 | Will | 606/217 |
| 4,929,487 | A | * | 5/1990 | Tilman et al. | 428/163 |
| 4,941,238 | A | | 7/1990 | Clark | 24/437 |
| 5,007,142 | A | | 4/1991 | Herrington | 24/400 |
| 5,007,143 | A | | 4/1991 | Herrington | 24/400 |
| 5,010,627 | A | | 4/1991 | Herrington et al. | 24/400 |
| 5,062,186 | A | | 11/1991 | Rampolla et al. | 24/389 |
| 5,067,208 | A | | 11/1991 | Herrington, Jr. et al. | 24/400 |
| 5,070,583 | A | | 12/1991 | Herrington | 24/400 |
| 5,152,613 | A | | 10/1992 | Herrington, Jr. | 383/63 |
| 5,161,286 | A | | 11/1992 | Herrington, Jr. et al. | 24/387 |
| 5,253,395 | A | | 10/1993 | Yano | 24/387 |
| 5,283,932 | A | | 2/1994 | Richardson et al. | 24/400 |
| 5,438,744 | A | | 8/1995 | Horikawa et al. | 29/408 |
| 5,599,415 | A | | 2/1997 | Tomic et al. | 156/159 |
| 5,636,415 | A | | 6/1997 | James | 24/399 |
| 5,664,299 | A | | 9/1997 | Porchia et al. | 24/400 |
| 5,722,128 | A | | 3/1998 | Toney et al. | 24/400 |
| 5,809,621 | A | | 9/1998 | McCree et al. | 24/399 |
| 5,867,875 | A | | 2/1999 | Beck et al. | 24/400 |
| 5,919,535 | A | | 7/1999 | Dobreski et al. | 428/35.2 |
| 5,991,980 | A | | 11/1999 | Meager | 24/400 |
| 6,033,113 | A | | 3/2000 | Anderson | 383/63 |
| 6,059,457 | A | | 5/2000 | Sprehe et al. | 383/63 |
| 6,185,796 | B1 | | 2/2001 | Ausnit | 24/30.5 |
| 6,305,844 | B1 | | 10/2001 | Bois | 383/64 |
| 6,363,531 | B1 | | 4/2002 | Quinn | |
| 6,385,818 | B1 | | 5/2002 | Savicki, Sr. | 24/30.5 |
| 6,394,299 | B1 | | 5/2002 | Hupp | 220/315 |
| 6,438,757 | B1 | | 8/2002 | Quinn | 2/82 |
| 6,510,595 | B2 | * | 1/2003 | Matsushima et al. | 24/433 |
| 6,558,037 | B2 | | 5/2003 | Gonella | |
| 6,721,999 | B2 | | 4/2004 | Meager | 24/399 |
| 7,062,786 | B2 | | 6/2006 | Stinton | |
| 2006/0037180 | A1 | | 2/2006 | Meager | |
| 2006/0107500 | A1 | | 5/2006 | Meager | |
| 2008/0022496 | A1 | | 1/2008 | Meager | |

FOREIGN PATENT DOCUMENTS

| | | |
|---|---|---|
| EP | 0279599 | 8/1988 |
| EP | 676 330 | 10/1995 |
| FR | 1043998 | 11/1953 |
| FR | 2507446 | 12/1982 |
| GB | 2267933 | 12/1993 |
| WO | WO 99/09854 | 3/1999 |
| WO | WO 02/087379 | 11/2002 |

OTHER PUBLICATIONS

Supplementary European Search Report dated Nov. 30, 2000 for European Patent Application No. 98944523.

Notification of Transmittal of the International Search Report or the Declaration dated Dec. 16, 1998 for International Patent Application No. PCT/US98/17599.

International Preliminary Examination Report for PCT Application No. PCT/US02/13558, mailed on Jan. 26, 2007.

International Search Report for International (PCT) Patent Application No. PCT/US05/38691, mailed Aug. 14, 2006.

Written Opinion for International (PCT) Patent Application No. PCT/US05/38691, mailed Aug. 14, 2006.

International Preliminary Report on Patentability for International (PCT) Patent Application No. PCT/US05/38691, mailed Issued May 1, 2007.

Official Action for U.S. Appl. No. 11/258,655, filed Jan. 30, 2008.

* cited by examiner

FIG. 4
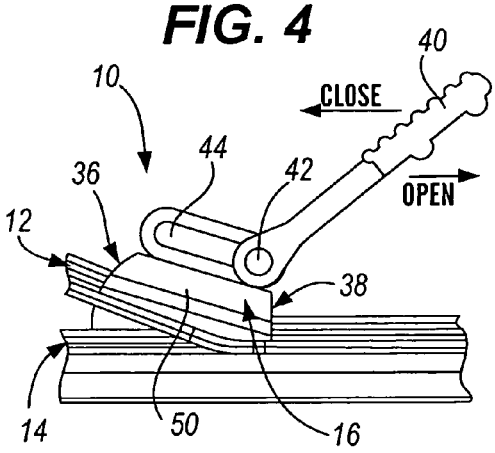
FIG. 5
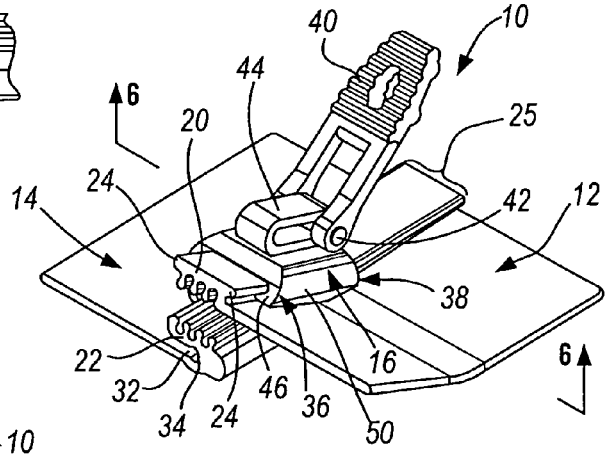
FIG. 6
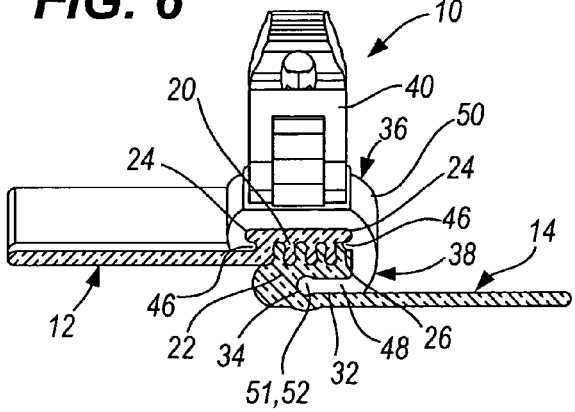
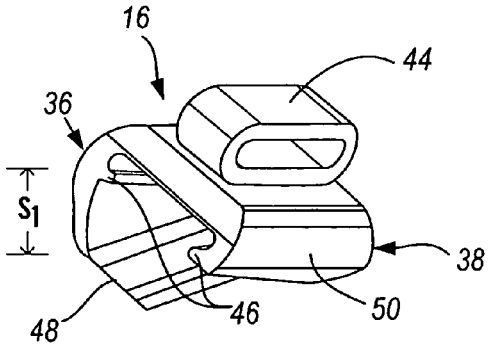
FIG. 7
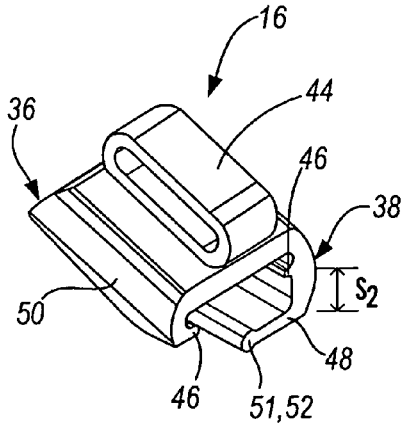
FIG. 8

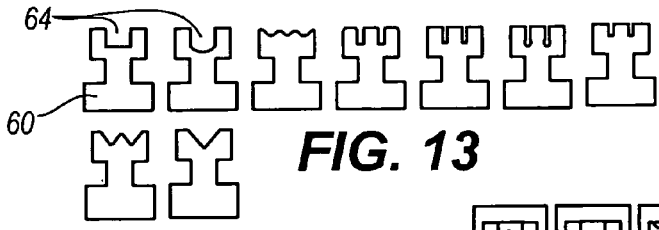
FIG. 13
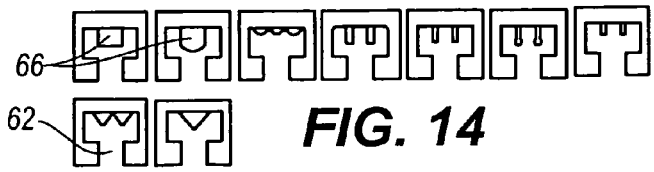
FIG. 14
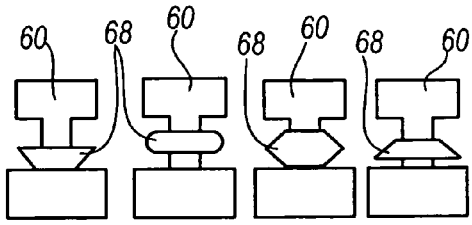
FIG. 15
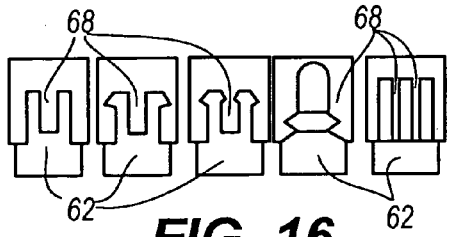
FIG. 16
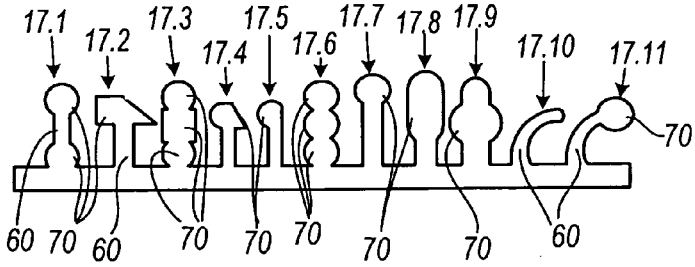
FIG. 17.1-17.11
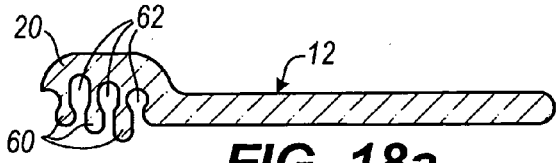
FIG. 18a
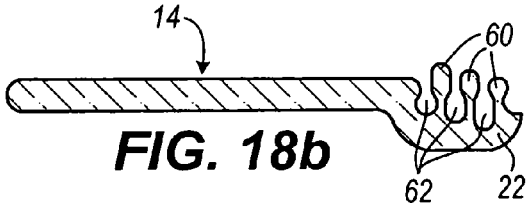
FIG. 18b
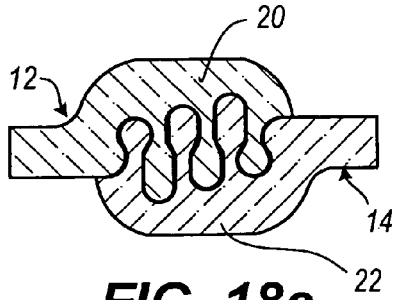
FIG. 18c FIG. 32
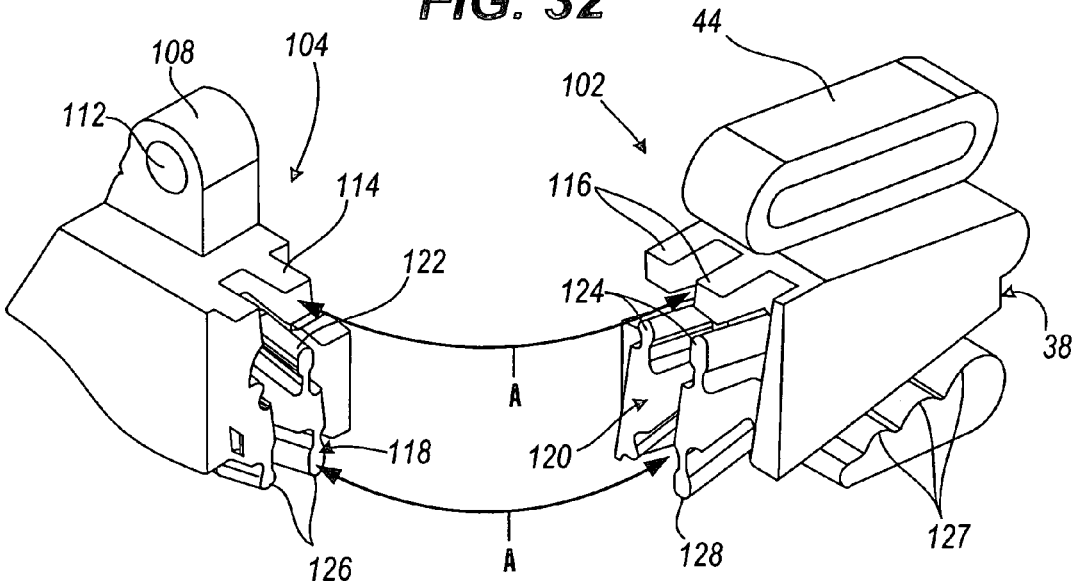
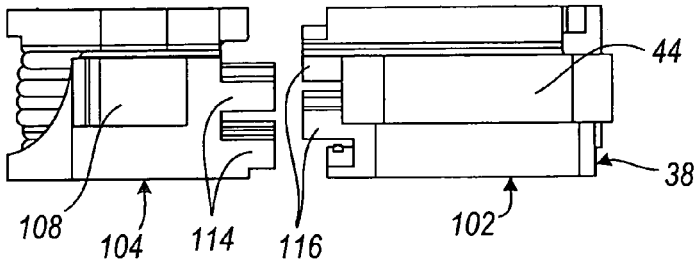
FIG. 33
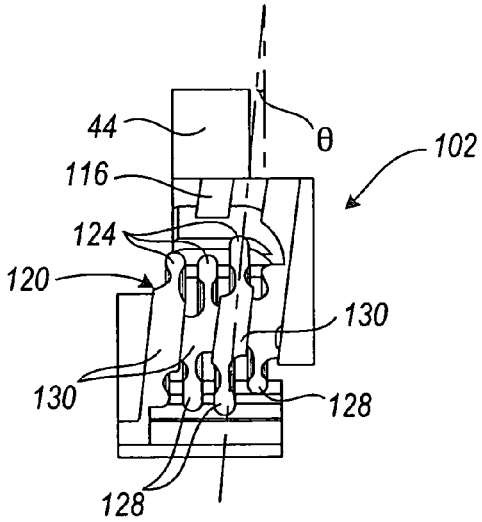
FIG. 34

DEVICE FOR CREATING A SEAL BETWEEN FABRICS OR OTHER MATERIALS

CROSS-REFERENCE TO RELATED APPLICATIONS

The present application is a continuation of U.S. patent application Ser. No. 10/135,881 entitled "DEVICE FOR CREATING A SEAL BETWEEN FABRICS OR OTHER MATERIALS" filed on Apr. 29, 2002, now U.S. Pat. No. 6,721,999 which claimed priority to U.S. Provisional Patent Application Ser. No. 60/287,938 filed on Apr. 30, 2001, and entitled "DEVICE FOR CREATING A WATERTIGHT SEAL BETWEEN FABRICS AND/OR OTHER MATERIALS." U.S. patent application Ser. No. 10/135,881 and Provisional Application Ser. No. 60/287,938 are incorporated herein by reference in their entirety.

FIELD OF THE INVENTION

The present invention relates to a device that is capable of creating a seal between fabrics and other materials.

BACKGROUND OF THE INVENTION

Fastening devices typically include two flexible elongated components having teeth which are forced to interlock and separate by moving a slide along the components. Although such fastening devices have long been used to close and open various articles, such as clothing and bags, such devices suffer from the allowance of liquids and gases within the fastener, and are therefore not useful for conditions in which a windproof, gas-tight and/or waterproof article is desirable.

Fluid-tight fasteners are available, but such fasteners are typically not fluid-tight at the ends of the fastener. Furthermore, other devices have sealing members that are aligned adjacent each other as opposed to extending away from each other. Still other devices are expensive, heavy, and/or require the use of a covering material over the fastener to establish a wind and/or watertight closure.

SUMMARY OF THE INVENTION

The unique feature of the present invention is its ability to provide a seal to an object that has two opposing surfaces of material, while always maintaining the slider portion of the device to the exterior of the enclosure.

In a first embodiment, the seal device is comprised of three main components (1) a upper seal member, (2) a lower seal member, and (3) a slider. The slider includes at least one lifting rib and a closure bar. In use, the slider is moved back and forth across the length of the seal to interlock the upper seal member to the lower seal member, thereby forming a seal. More particularly, the slider body includes a confining portion that presses the upper seal member into the lower seal member when the slider is moved in a closing direction. To open the seal, the lifting rib within the slider pulls the upper seal member away from the lower seal member that is anchored to the bottom of the slider by the closure bar.

In a modification of the first embodiment, a slider is provided that only contains one lifting rib within an opening portion of the slider. The closure portion of the slider includes a closure bar that anchors the lower seal member, and allows the slider body to press the upper seal member into the lower seal member to close the seal. The closure portion may include a canted portion that tilts, thereby creating some slight rotation of the upper seal member as it enters the lower seal member, thereby improving the seal quality. The opening portion of this modified embodiment preferably includes one lifting rib that separates the upper seal member from the lower seal member by lifting the upper seal member under its lifting wing. Separation from the lower seal member occurs because the lower seal member is anchored to the bottom of the slider by the closure bar that preferably extends the length of the slider. When used with one lifting rib, the opening portion creating some slight rotation of the upper seal member as it exits the lower seal member, thereby improving the ease of slider movement and the longevity of the seal quality.

In a second embodiment, a waterproof sealing device is comprised of four main components (1) a upper seal member, (2) a lower seal member, (3) a slider, and (4) a plug. The upper seal member of this embodiment does not require a lifting wing. Furthermore, the lower seal member does not require a closure bar groove. The slider of this embodiment has interior structure that mates and cooperates with the seal surfaces of the upper seal member and the lower seal member. Furthermore, the shape of the interior structure of the slider is analogous to a funnel. As the slider is passed along the length of the seal, the slider confines the seal at its closing end to from the seal. That is, the upper seal member and the lower seal member are funneled together. When used in an opening direction, the opposite occurs, and the interior structure of the seal separates the upper seal member from the lower seal member.

The second embodiment creates a waterproof seal at the end-most extent of the seal using the plug. The plug is permanently affixed to the end of the seal. Furthermore, the plug contains interior structure that mates with mating surfaces of the upper seal member and the lower seal member. In addition, the structure of the plug mates with the slider when the slider is moved into its closing position with the slider. Therefore, the mating surfaces of the upper seal member and the lower seal member create a seal around the interior structure of both the slider and the plug when the slider is moved into its closing position with the plug.

BRIEF DESCRIPTION OF THE DRAWINGS

Several figures have been developed to assist with understanding the invention. Following is a brief description of the figures that illustrate the invention and its various embodiments:

FIG. 4 provides a side elevation view of a preferred embodiment of the present invention showing the slider component within the upper and lower seal members;

FIG. 5 provides a perspective view of the configuration shown in FIG. 4;

FIG. 6 provides an elevation view of the closing end of the slider taken along line 6-6 of FIG. 5;

FIG. 7 provides a perspective view of a preferred embodiment the slider component looking at the opening end;

FIG. 8 provides a perspective view of a preferred embodiment the slider component looking at the closing end;

FIG. 13 is a cross-sectional view showing a variety of notch patterns available for male mating surface members;

FIG. 14 is a cross-sectional view showing a female mating surface members corresponding to those depicted in FIG. 13;

FIG. 15 is a cross-sectional view showing several additional shape patterns that may be added to male mating surface members;

FIG. 16 is a cross-sectional view showing several additional shape patterns that may be added to female mating surface members;

FIG. 17.1-17.11 are cross-sectional views of several simple shape patterns that may be added to make mating surface members;

FIG. 18*a* is an upper seal member that may be interlocked with a lower seal member of the exact same shape;

FIG. 18*b* is a lower seal member that may be interlocked with the seal member depicted in FIG. 18*a;*

FIG. 18*c* is the seal formed using seal members depicted in FIGS. 18*a* and 18*b;*

FIG. 32 is a perspective view of the plug and slider of the second embodiment;

FIG. 33 is a plan view of the plug and slider depicted in FIG. 32;

FIG. 34 is a front elevation view of the slider depicted in FIG. 32.

While the following disclosure describes the invention in connection with those embodiments presented, one should understand that the invention is not strictly limited to these embodiments. Furthermore, one should understand that the drawings are not necessarily to scale, and that in certain instances, the disclosure may not include details which are not necessary for an understanding of the present invention, such as conventional details of fabrication and assembly.

DETAILED DESCRIPTION OF THE INVENTION

One embodiment of the present invention is a device for creating a seal. The device includes an upper seal member, a lower seal member and a slider. The upper seal member has a first mating surface and a lifting wing. The lower seal member has a second mating surface and a closure bar groove. The first and second mating surfaces interlock to form a seal. The slider includes a lifting rib that slideably cooperates with the lifting wing of the upper seal member, and a closure bar that slideably cooperates with the closure bar groove of the lower seal member. The slider also includes a body having a closing end at which the lifting rib is in closing proximity with the closure bar and an opening end wherein the lifting rib is in opening proximity with the closure bar. When the slider is moved in a direction causing the upper seal member and the lower seal member to pass within the slider from the opening end to the closing end, the slider confines the first mating surface into contact with the second mating surface thereby creating a seal.

Figure 1:
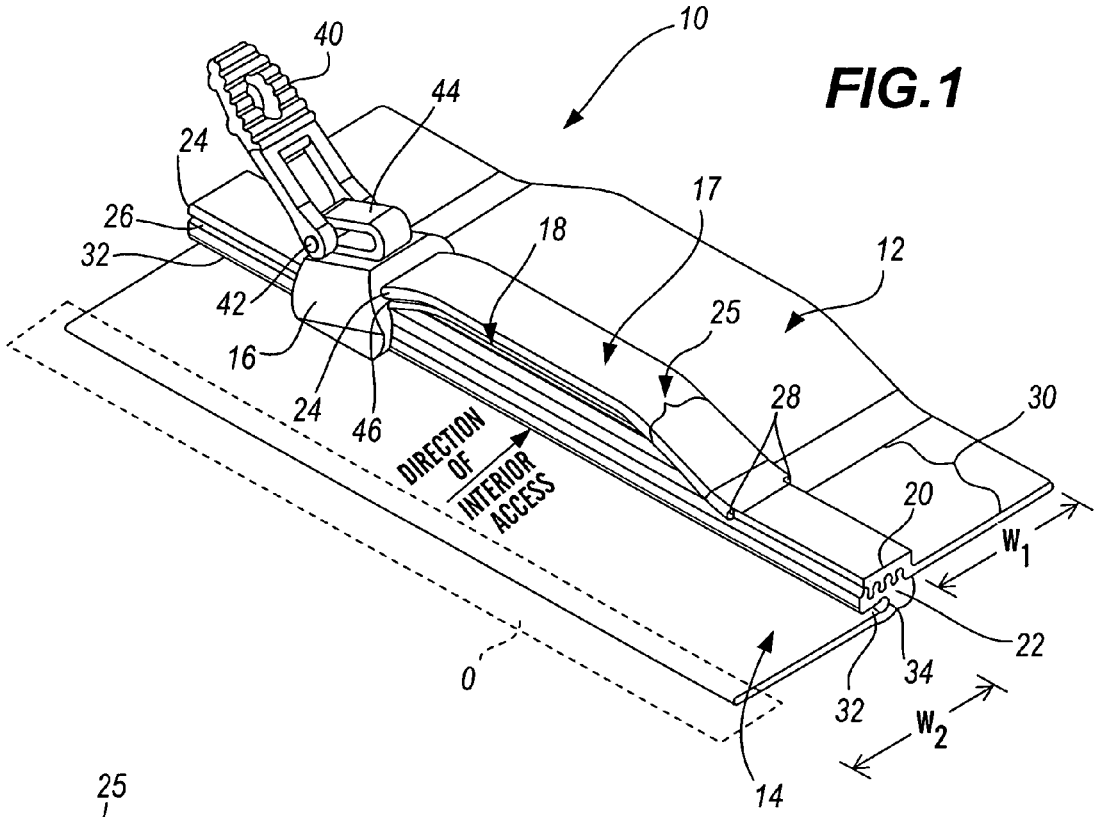
FIG. 1 provides a perspective view of a first embodiment of the waterproof sealing device of the present invention.

Referring initially to FIG. 1, a perspective view of the sealing device 10 is shown. The sealing device 10 includes an upper seal member 12, a lower seal member 14, and a slider 16. Sealing device 10 creates a seal 17 along the entire length of upper seal member 12 and lower seal member 14. When device 10 is unsealed, an opening 18 exists between upper seal member 12 and lower seal member 14, thereby providing access to the space to the interior of the seal 17.

In use, a seal 17 is formed by sliding slider 16 down the length of seal 17, which causes the slider 16 to interlock the mating surface 20 of upper seal member 12 with the mating surface 22 of lower seal member 14. As such, the present invention bears similarity to a zipper, whereby the user of the device zips the device 10 closed to form a seal, and unzips device 10 to gain access to the interior of the seal 17.

Figure 2:
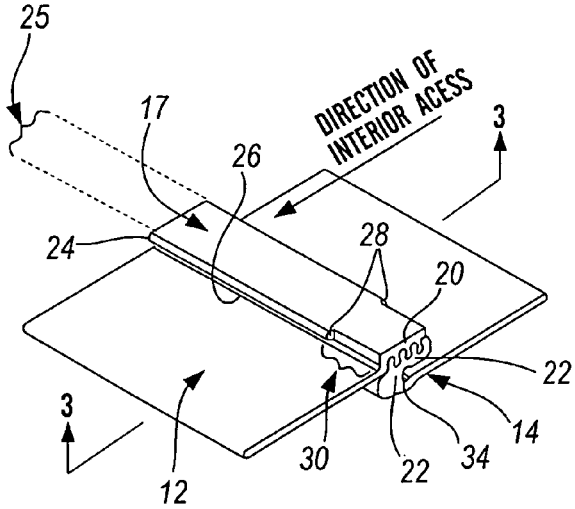
FIG. 2 provides a perspective view of a first embodiment of the upper sealing member and the lower sealing member portions of the present invention.

Referring now to FIG. 2, a perspective view of upper seal member 12 and lower seal member 14 is shown without the slider 16 present. FIG. 2 clearly illustrates that, if desired, upper seal member 12 may be reversed relative to lower seal member 14. That is, FIG. 1 illustrates that upper seal member 12 extends to the upper right of the page, while the lower seal member 14 extends to the lower left of the page. Conversely, FIG. 2 illustrates that upper seal member 12 may extend in a reverse direction, that is, to the lower right of the page, while the lower seal member 14 extends to the upper right of the page. Therefore, sealing device 10 can be configured to provide access from either direction to the interior of the article to which it is attached. Of course, if seal 17 is sufficiently long, when unsealed upper seal member 12 may be moved away from lower seal member 14 to provide extensive access from any direction to the interior of the article to which device 10 is attached.

Figure 3:
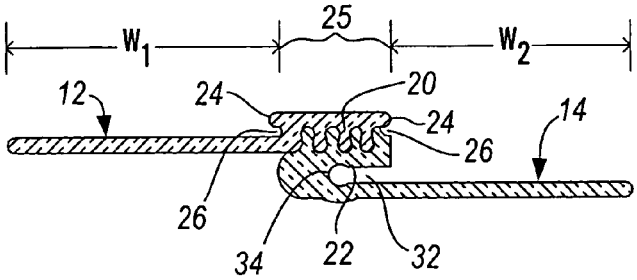
FIG. 3 provides a cross-sectional view of the upper and lower sealing members taken along line 3-3 of FIG. 2.

Referring now to FIG. 3, a cross-sectional view of interlocked upper seal member 12 and lower seal member 14 is depicted. This figure provides a detail view of the structure of the two interlocking members. The upper seal member 12 preferably includes at least one lifting wing 24, and may include two or more lifting wings 24 as depicted in FIG. 3. More specifically, in a preferred embodiment, a portion of upper seal member 12 includes a lifting wing 24 that juts out from the main profile portion 25 of the upper seal member 12. Lifting wing 24 thus creates a lifting wing groove 26 directly thereunder that serves as a receiving location for a lifting rib 46 of slider 16, discussed in detail below. Lifting wing 24 may be a variety of shapes, as may lifting groove 26. If the lifting wing 24 is removed, as depicted starting at location 28 in FIGS. 1 and 2, the absence of the lifting wings 24 prevents the lifting rib 46 of slider 16 from placing a separation force on the upper seal member 12, and thereby prevents slider 16 from separating seal 17 at the beginning of location 28 of the seal 17. Accordingly, an end portion 30 of seal 17 preferably contains a section that is slightly shorter than the length of the slider 16, whereby the lifting wings 24 are absent from the upper seal member 12. In use, when slider 16 is pulled along to the end portion 30 of the seal 17, the lifting rib 46 of the slider 16 disengages from the lifting wing groove 26, thus preventing separation at the front end of the slider 16. This disengagement allows the seal at the front of the slider 16 to remain sealed, thereby providing a seal along the entire length of seal 17, including the end portion 30 where slider 16 is positioned for closure of seal 17.

Still referring to FIG. 3, a closure bar groove 32 is provided for stabilizing lower seal member 14 during operation of the slider 16. In a preferred embodiment, lower seal member 14 includes a closure bar groove 32. Closure bar groove 32 is designed to receivingly accept a closure bar 48 of slider 16, shown, e.g., in FIG. 6. Closure bar groove 32 maybe of different lengths and shapes, as will be discussed below. Furthermore, closure bar groove 32 may include an end shape 34 that corresponds to an end shape 51 of the terminus 52 of the closure bar 48, as discussed below.

Referring now to FIGS. 1-3, mating surface 20 of upper sealing member 12 and mating surface 22 of lower sealing member 14 provide the structure for creating a functioning seal 17. More particularly, upper seal member 12 includes a mating surface 20 that has a shape that mates with mating surface 22 of lower seal member 14, thereby creating a seal 17. The shape of the mating surfaces 20 and 22 may vary, as discussed below. In use, mating surface 20 is forced into interlocking position with opposing mating surface 22, thus creating seal 17.

Referring to FIGS. 1 and 3, it is an aspect of the present invention to utilize materials of sufficient dimension and material type such that seal 17 may be incorporated into a variety of different objects, such as wet suits, waders, rain gear, marine apparel, and boots, to name but a few. Accordingly, upper seal member 12 preferably includes a sufficient width $W_1$ of runout material such that it may be permanently attached to an object to form one side of the seal on the object. Similarly, the lower seal member 14 also includes a sufficient width $W_2$ of runout material such that it too may be permanently attached to an object to form a second side of the seal for the object. Upper seal member 12 and lower seal member 14 are made of resilient material that is capable of interlocking to form a seal. The upper and lower seal members 12, 14 can be made of the same or different resilient materials. Such materials may include, but are not limited to rubber or plastic, such as poly-vinyl chloride (PVC) or linear low density polyethylene (LLDPE). Depending upon the material used, the upper seal member 12 and lower seal member 14 may be glued, heat welded, or otherwise bonded to adjacent material of the enclosure object O, as shown in phantom lines in FIG. 1. Alternatively, the seal 17 of the present invention may be formed as an integral part of the object during manufacture of the object itself. In one aspect of the invention, the upper and lower seal members are attached to adjacent material surfaces as part of a product, such as, for example, a jacket front. Thus, the material surfaces would be the left and right front sides of the jacket, which substantially define a first plane. The interlocked first and second mating surfaces of the upper and lower seal members also substantially define a plane, such as is illustrated in FIG. 6. In this aspect of the invention, these two planes are substantially parallel.

It is an aspect of the present invention that a variety of materials may be used to construct a single device 10. The slider 16 is preferably made of a relatively hard material, such as, without limitation, a hard plastic, rubber, ceramic, metal, metal alloy, or a combination thereof Mating surfaces 20 and 22 may, if desired, incorporate a multitude of materials. For example, individual male shapes 60 and female shapes 62 may be formed of one material, such as soft rubber, while the remaining portions of the upper seal member 12 and lower seal member 14 may be manufactured of a somewhat harder material that still behaves in a resilient manner. Furthermore, upper seal member 12 and lower seal member 14, including mating surfaces 20 and 22 may incorporate metallic or hard plastic inserts, while hook and loop materials such as velcro may be incorporated into the device 10 as well. In addition, a variety of other materials, such as, without limitation, gel, silicone, polytetrafluoroethylene (PTFE) fibers, metal or coil zipper sections, lubricants, and/or sealants may all be used in or on one or more of the components of the inventions disclosed herein.

The device for creating a seal of the present invention has a wide variety of uses and advantages. In general, the device can be used for outdoor clothing and apparel, outdoor equipment and cases, marine apparel and equipment, and even for everyday apparel. The device is particularly useful for products that are required to be fully watertight. Such products include, without limitation, hazardous material suits, fire suits, dry suits, dry bags, bivy sacks, waders, space suits, tents, shipping packages, household storage bags, map cases, chart cases, kayak skirts, backpack covers, computer cases, electronic device cases, watercraft containers, inflatable cases (for cameras, etc.), flotation bags, flotation devices, waterproof pockets, fishing vest pockets, smell-proof pockets (for bears, etc.), and wetsuits. The device of the present invention is also particularly useful for products requiring or benefitting from being wind proof. Such products include, without limitation, jackets, sleeping bags, rain gear, boots, kayak jackets, wind breakers, wind proof fleeces, and tents. In addition to the advantages of being waterproof and wind proof, the device of the present invention has a number of other advantages, including, without limitation, being: airtight, watertight, gas tight, wind proof, quiet, less likely to get caught or jammed, lightweight, nonmetal (i.e., light, cheap and not cold), fully recyclable, smooth to operate, inexpensive and easy to produce. This device also eliminates the need for zipper-covering flaps and can be used in essentially any zipper function, thereby allowing hundreds of new products to be made using the device. Specifically, such new products can include the following: zip-down waders, zip-down dry bags, zip-down bivy sacks, easy access kayak skirts, fully waterproof rope bags, fully waterproof pockets, watertight/airtight shipping packages, easy access dry suits, everyday camera bags for underwater photos or films, fully waterproof and fully functional backpacks or fanny packs, zip-down rain pants and zip-in-half rain tarps.

Referring now to FIG. 4, a side elevation view of a slider 16 is depicted engaged in upper seal member 12 and lower seal member 14. The slider 16 includes an opening end 36 and a closing end 38. When pulled in either direction along the seal profile 17, the last end of the slider 16 to pass the profile renders the seal either opened or closed. More specifically, opening end 36 serves to separate the upper seal member 12 from the lower seal member 14. Therefore, as slider 16 is pulled along the seal 17, it will open the seal 17 if pulled such that closing end 38 leads opening end 36. Conversely, closing end 38 of slider 16 confines and presses the upper seal member 12 into interlocking union with lower seal member 14. Therefore, as slider 16 is pulled along the seal 17, it will close the seal 17 if pulled such that opening end 36 leads closing end 38. In this mechanism of opening and closing, the seal is opened by force being applied by the lifting rib to the lifting wing to pull the upper seal member from the lower seal member. This mechanism is different from sealing devices where a force is applied directly to a mating or contacting surface that makes a seal.

Still referring to FIG. 4, a pull tab 40 is preferably mounted along the top of slider 16 using a pin 42 to interconnect pull tab 40 within a pull tab sliding track 44. Pull tab 40 slides back and forth in the pull tab sliding track 44 allowing for a more effective pulling angle for the slider 16, thus allowing for a smoother and easier effort to manipulate slider 16.

Referring now to FIG. 5, a lifting rib 46 can be seen at the opening end 36 of slider 16. Lifting rib 46 provides a structure for applying a separating force to the upper seal member 12 relative to the lower seal member 14.

Referring now to FIG. 6, an elevation view of the closing end 38 of the slider 16 taken along line 6-6 of FIG. 5 is provided. FIG. 6 depicts the disposition of the upper seal member 12 and lower seal member 14 at the closing end 38 of slider 16. At the closing end 38, closure bar 48 fits within closure bar groove 32 of lower seal member 14, and serves to confine the mating surface 22 of lower seal member 14 within the body 50 of slider 16. The body 50 of slider 16 is confined at the closing end 38 of slider 16 such that the mating surface 20 of upper seal member 12 is forced to interlock with mating surface 22 of lower seal member 14.

FIG. 7 provides a perspective view of slider 16 looking at the opening end 36 of the slider 16. In contrast, FIG. 8 provides a perspective view of slider 16 looking at the closing end 38 of the slider 16. Lifting ribs 46 located on both lateral sides of slider 16 are shown. It should be noted that lifting ribs 46 can extend along the entire lateral side of slider 16 or along only a portion thereof, such as along the front half of the slider 16 at the opening end 36. The distance between the lifting ribs 46 and the closure bar 48 at the opening end 36 is significantly greater than at the closing end 38 of slider 16. More specifically, separation distance $S_1$ depicted in FIG. 7 is greater than separation distance $S_2$ depicted in FIG. 8. Separation distance $S_1$ is sufficiently large to separate the mating surface 20 of upper seal member 12 from the mating surface 22 of lower seal member 14. Referring back to FIG. 5, the separation of upper seal member 12 from lower seal member 14 is clearly illustrated at the opening end 36 of slider 16. In contrast, referring back to FIG. 6, the geometry of the closing end 38 of slider 16 is such that upper seal member 12 is in interlocking position with the lower seal member 14. Thus, the distance between the opening end 36 and closing end 38 of slider 16 is a transition zone, whereby upper seal member 12 is releasably separated from lower seal member 14 at opening end 36, or where upper seal member 12 is releasably interlocked with lower seal member 14 at closing end 38.

Figure 9A:
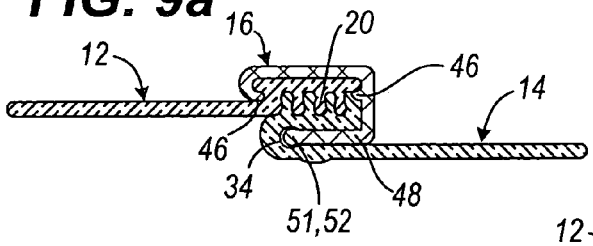
FIG. 9*a* is a cross-sectional view of a seal profile in which the slider has a long closure bar.
Figure 9B:
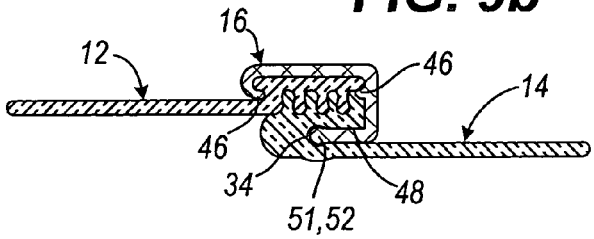
FIG. 9*b* is a cross-sectional view of a seal profile in which the slider has a moderate length closure bar.
Figure 9C:
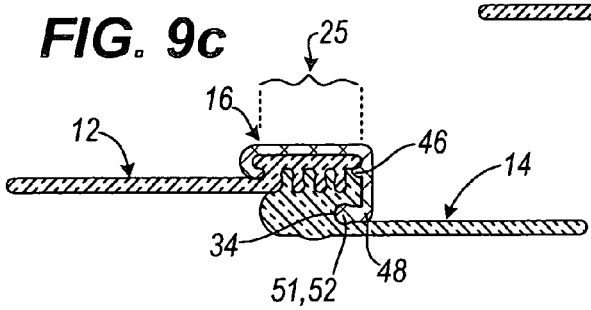
FIG. 9*c* is a cross-sectional view of a seal profile in which the slider has a short closure bar.
Figure 9D:
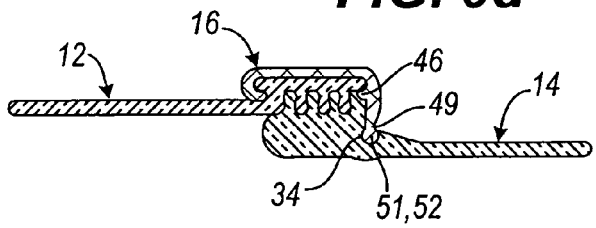
FIG. 9*d* is a cross-sectional view of a seal profile in which the slider has a prong-shaped closure bar.

The component parts of the present invention may incorporate a myriad of different configurations. Referring now to FIGS. 9*a*-9*o*, cross-sectional views of the upper seal member 12 and lower seal member 14 at the closing end 38 of slider 16 are depicted. FIG. 9*a* illustrates that the closure bar 48 may be rather long relative to the width of the seal profile. FIG. 9*b* depicts yet a different modification where the closure bar 48 is of moderate length. With reference to FIG. 9*c*, a relatively short closure bar 48 is depicted, and in FIG. 9*d*, the closure bar 48 is essentially prong-shaped, but still extends into lower seal member 14, although it has negligible lateral length. In the configurations depicted in FIGS. 9*a*-9*d*, the closure bar groove 32 located in lower seal member 14 is manufactured to receive the corresponding sized closure bar 48.

Figure 9E:
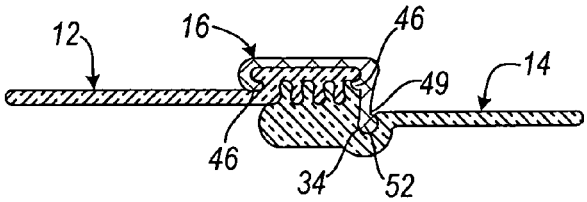
FIG. 9*e* is a cross-sectional view of a seal profile in which the slider has a prong-shaped closure bar with seal members at the same elevation.

Referring now to FIG. 9*e*, lower seal member 14 may be configured to different elevations relative to upper seal member 12. FIG. 9*e* shows that lower seal member 14 may be wrapped around the closure bar 48, such that it rises to the same elevation as the corresponding surface of upper seal member 12. This modification allows for a relatively low profile zipper-like configuration in the vicinity of the seal 17.

Figure 9F:
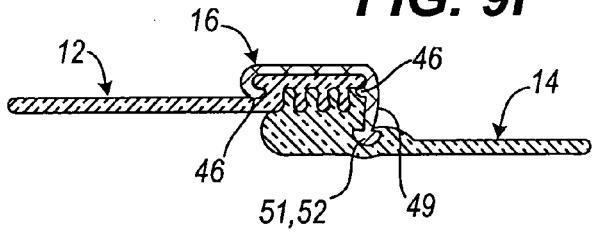
FIG. 9*f* is a cross-sectional view of a seal profile in which the slider has a prong-shaped closure bar having an alternate end shape.
Figure 9G:
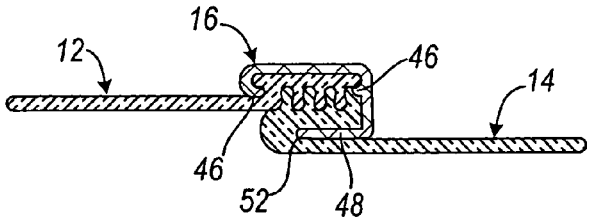
FIG. 9*g* is a cross-sectional view of a seal profile in which the slider has a moderate length closure bar with no end shape.

Referring now to FIG. 9*f*, a variety of end shapes 51 may be used at the terminus 52 of the closure bar 48. Alternately, a simple shape may be used at any point (not shown) along the length of closure bar 48. FIG. 9*f* illustrates that a truncated half circle resembling an arrow may be used as the end shape 51 at terminus 52 of the closure bar 48. Accordingly, although not illustrated, it is to be understood that the terminus 52 may have an end shape 51 taking many forms, including, but not limited to circles, triangles, rectangles, arrow heads, barbs, and polyhedral shapes. Furthermore, as shown in FIG. 9*g*, the terminus 52 of closure bar 48 may be without any type of additional shape at all. This modification is particularly applicable in the case where the closure bar 48 is longer than a simple prong shape, thus providing confinement capability and support to the mating areas of the profile simply by virtue of its length under the mating area itself.

Figure 9H:
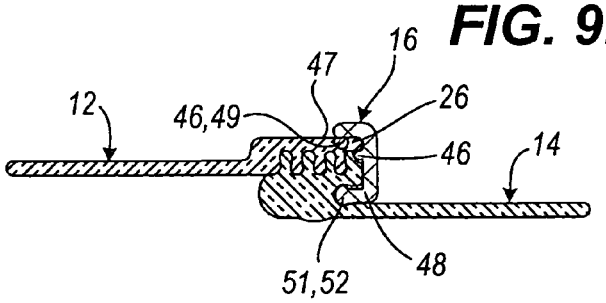
FIG. 9*h* is a cross-sectional view of a seal profile in which the slider has top and side mounted lifting rib.

FIG. 9*h* depicts a modified slider 16 shape that does not wrap around the top surface of the upper seal member 12. Here, the modified slider 16 of FIG. 9*h* has a lifting rib 46 that projects into the top surface 47 of the mating profile of the upper seal member 12. In addition, a second lifting rib 46 in located along the side of slider 16. Advantageously, the topmost lifting rib 46 of this modified slider 16 includes a shape 49 to anchor the lifting rib 46 within the lifting rib groove 26.

Figure 9I:
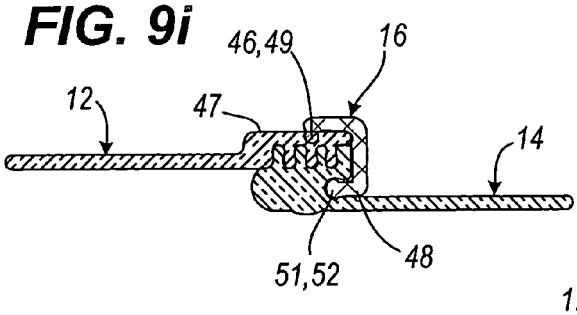
FIG. 9*i* is a cross-sectional view of a seal profile in which the slider has top mounted lifting rib.

A variety of shapes 49 for the lifting rib 46 and corresponding lifting rib groove 26 may be used to provide a mechanism for anchoring the lifting rib 46 within the top surface 47 upper seal member 12, such that lifting rib 46 pulls the upper seal member 12 out of the lower seal member 14 at the opening end 36 of slider 16. Referring now to FIG. 9*i*, a slider 16 having a single lifting rib 46 is provided. More specifically, the modified slider 16 as presented in FIG. 9*i* utilizes a single lifting rib 46 that projects into the top surface 47 of the mating profile 20 of upper seal member 12. As with the slider illustrated in FIG. 9*h*, the slider 16 of FIG. 9*i* uses a shape 49 at the end of the single lifting rib 46 to provide a structure for pulling the upper seal member 12 out of the lower seal member 14 when the profile passes through the opening end 36 of slider 16.

Figure 9J:
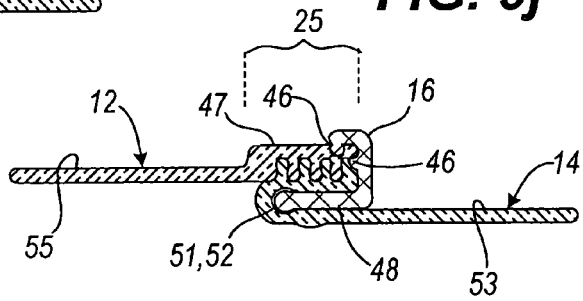
FIG. 9*j* is a cross-sectional view of a seal profile in which the slider has top mounted lifting rib with seal members at the same elevation.

FIG. 9*j* illustrates that a combination of the above described features may be utilized to form a slider/seal combination. Here, FIG. 9*j* illustrates a slider 16 having a relatively long closure bar 48, and also having two lifting ribs 46, the first lifting rib 46 located on the side of the slider 16, and the second lifting rib 46 is located along the top surface 47 of the main profile portion 25 of the upper seal member 12. Furthermore, lower seal member 14 is wrapped around the side of slider 16 and rises to an elevation such that the top lateral surface 53 of lower seal member 14 is at about the same elevation as the top lateral surface 55 of upper seal member 12.

Figure 9K:
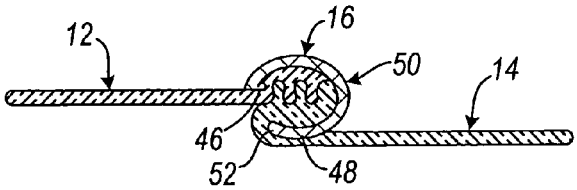
FIG. 9*k* is a cross-sectional view of a seal profile in which the slider is cylindrically shaped.

Referring now to FIG. 9*k*, a slider 16 having a cylindrical shape is shown. The cylindrical shaped slider 16 includes a closure bar 48 and a body 50 that wraps around the exterior of the main profile portion 25 of upper seal member 12, where it terminates at a lifting rib 46. Accordingly, the shape of the slider 16 may vary considerably and yet provide the function of opening and closing seal 17.

Figure 9L:
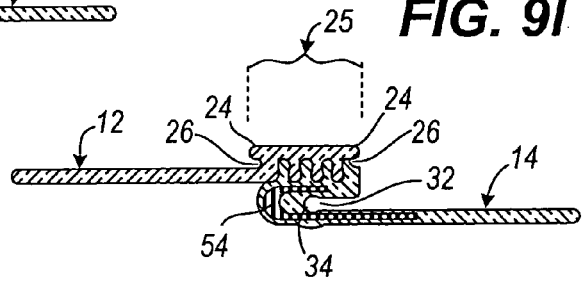
FIG. 9*l* is a cross-sectional view of a seal profile having a hook-shaped stiffener insert.

Referring now to FIG. 9*l*, a stiffener insert 54 is provided for strengthening the profile system of the present invention. More specifically, a plurality of stiffener inserts 54 may be spaced along portions of the seal 17 of the present invention, by including inserts 54 within lower seal member 14. The inserts 54 provide a stronger seal structure, while at the same time permitting the seal to behave in a relatively flexible manner as a result of the spaced nature of placement. Spaced placement of inserts is disclosed in U.S. Pat. No. 5,991,980, the contents of which is incorporated herein by reference, in its entirety.

Figure 9M:
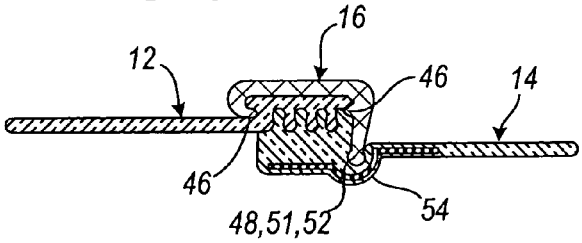
FIG. 9*m* is a cross-sectional view of a seal profile having a curved stiffener insert modified for placement in seal members that are at the same elevation.
Figure 9N:
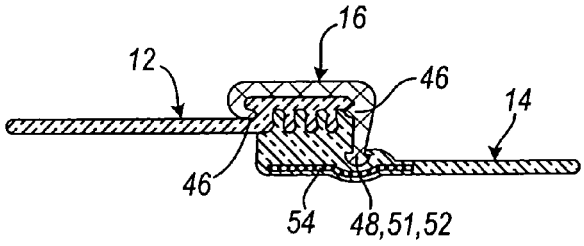
FIG. 9*n* is a cross-sectional view of a seal profile having a stiffener insert that is nearly flat.
Figure 9O:
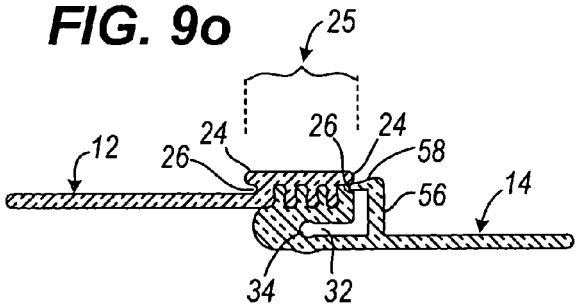
FIG. 9*o* is a cross-sectional view of a seal profile having a stabilizing rib attached to the lower seal member.

Referring again to FIG. 9*l*, the insert 54 is shown bending to follow the general shape of lower seal member 14, where lower seal member 14 includes a closure bar groove 32. Stiffener inserts 54 may be used in any profile shapes disclosed herein. For example, FIG. 9*m* illustrates a slider 16 having a closure bar 48 that is essentially prong shaped. Here, insert 54 follows the general contour of the lower seal member 14, which rises in elevation to match the elevation of the upper seal member 12. Similarly, FIG. 9*n* illustrates the use of an insert 54 with slider 16 that has a semi-circle end shape 51 at the terminus 52 of the closure bar 48.

Referring now to FIG. 9*o*, in a separate aspect of the present invention, a seal member rib 56 may be used to provide additional stability to the seal profile. More particularly, seal member rib 56 is a structure that protrudes from lower seal member 14 to buttress the interlocked main profile portions 25 of upper seal member 12 and lower seal member 14. The seal member rib 56 serves to assist in preventing the main profile portions 25 of interlocked upper seal member 12 and lower seal member 14 from shifting or rotating toward lower seal member 14. Preferably, the rib end 58 of seal member rib 56 protrudes into lifting rib groove 26, thereby adding additional stability. Seal member rib 56 may be formed in a variety of shapes and may include a stiffener insert 54. Furthermore, seal rib member 56 may be configured to fit over (not shown) at least a portion of the profile section of upper seal member 12. In use, closure bar 48 of slider 16 passes through closure bar groove 32, deflecting seal member rib 56 outward away from the seal profile area until the upper seal member 12 is interlocked with the lower seal member 14. After the slider 16 passes a section of the profile, seal member rib 56 returns to a position that buttresses the seal profile, as shown in FIG. 9*o*.

Figure 10:
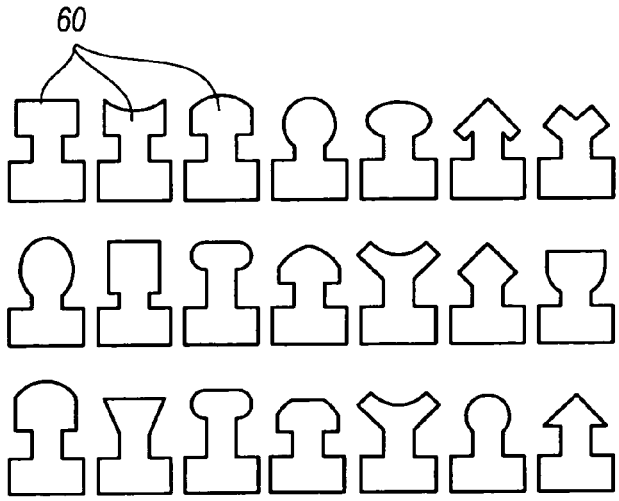
FIG. 10 is cross-sectional view showing a number of possible shapes for male mating surface members.
Figure 11:
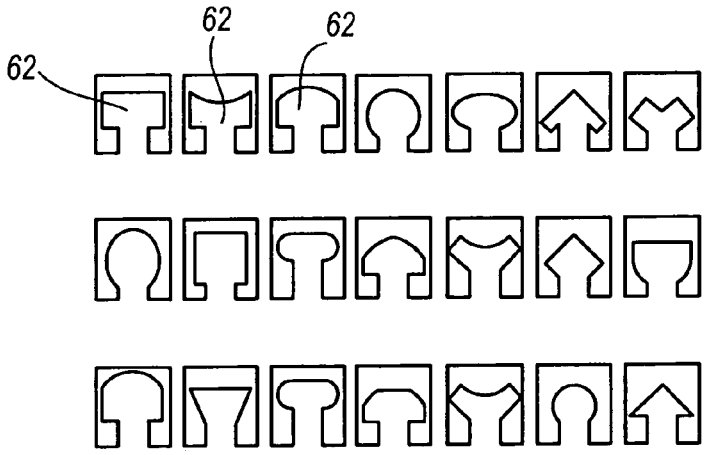
FIG. 11 is a cross-sectional view showing female mating surface members corresponding to those depicted in FIG. 10.
Figure 12:
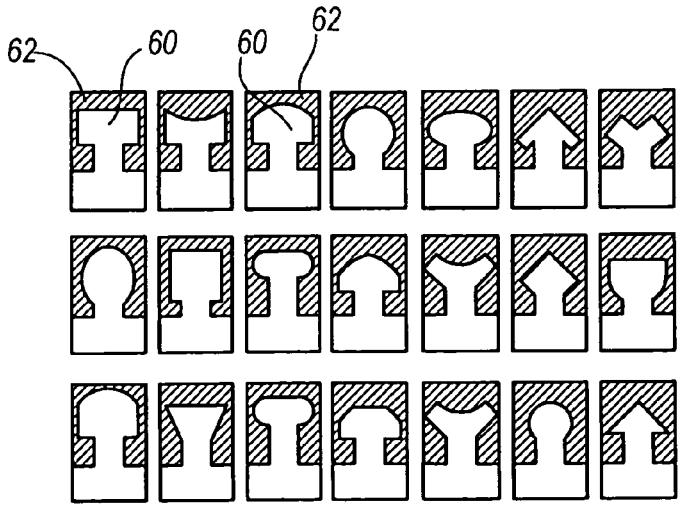
FIG. 12 is a cross-sectional view showing the combined male and female mating surface members depicted in FIGS. 10 and 11.

As illustrated in FIG. 3, the seal is formed by forcing mating surface 20 of upper seal member 12 in interlocking contact with the mating surface 22 of lower seal member 14. Mating surfaces 20 and 22, therefore, are mating shapes that allow the two surfaces to interlock, thereby forming a seal. Each mating surface is formed of at least one, or alternatively, a plurality of male shapes 60 and female shapes 62 that mate with each other. Referring now to FIG. 10, various individual male mating shapes 60 are presented. As FIG. 10 illustrates, a wide range of male shapes 60 are possible. FIG. 11 illustrates a matching set of female shapes 62 that may be paired with the male shapes 60 to form interlocking pairs 64 of male shapes 60 and female shapes 62, as shown in FIG. 12. When forming a mating surfaces 20, 22, a different assortment of male shapes 60 and females shapes 62 may be used to form a plurality of shapes in one mating surface 20, 22, so long as each male shape 60 matches with a corresponding female shape 62. Thus, a wide variety of combinations of male shapes 60 and female shapes 62 may be used to create unique matched sets of mating surfaces 20 and 22. Furthermore, mating surfaces 20, 22 may include one, two, three, or a substantially greater number of male shapes 60 and female shapes 62. For example, the device 10 may have applications in the medical implant field where mating surfaces 20, 22 containing hundreds or thousands of tongue and groove, or male shapes 60 and female shapes 62 are desirable.

Referring now to FIG. 13, a variety of different complex shapes may be used to form male shapes 60. That is, for every male shape 60 depicted in FIG. 10, additional grooves or notches 64 may be made in those male shapes 60. As shown in FIG. 14, where male shapes 60 with notches 64 are used, corresponding female shapes 62 preferably include projections 66 to mate with the notches 64.

In addition to the above noted complex shapes that may be used, shape additions 68, such as those shown in FIG. 15, may be added to male shapes 60. Similarly, as shown in FIG. 16, female shapes 62 may be provided that also include additional shapes 68. Where used, the opposing mating surface 20 or 22 includes appropriate indentations or notches (not shown) to accommodate the shape additions 68.

Referring now to FIGS. 17.1-17.11, it is a further aspect of the present invention to provide mating surfaces 20 and 22 that include a variety of shapes 70 along the length of the male shapes 60, as may be desired. For illustration purposes, all of the shapes shown are male shapes 60. However, it is to be understood that corresponding female shapes 62 are preferably used to mate with the male shapes 60 that may incorporate a simple shape 70 anywhere along its length. FIG. 17.1 shows a simple shape 70 located on the top and the bottom of the male shape 60, but with no shape in the middle. The simple shape 70 shown is a half circle on each side of the male shape 60. However, it is to be understood that the simple shape 70 could take on any form, such as a rectangle, triangle, etc. FIG. 17.2 illustrates a male shape 60 having two different simple shapes 70 on either side at its top. FIG. 17.3 illustrates three simple shapes 70 stacked on top of each other along the length of male shape 60. FIGS. 17.4 through 17.9 illustrate several other possible combinations of simple shapes that may be used. Combinations other than those illustrated are possible and within the scope of the present invention. FIG. 17.10 illustrates that the male shape 60 may be curved. In addition, FIG. 17.11 illustrates that a curved male shape 60 may include a simple shape along its length, such as at its end. In sum, male shapes 60 may be contain notches 64, additional shapes 68, simple shapes 70 and/or curved members to create a mating surface 20, 22. Female shapes 62 preferably mate with male shapes 60, and incorporate appropriate shapes, such as projections 66, as may be required to mate with male shapes 60.

FIGS. 18*a* and 18*b* illustrate that a upper seal member 12 and lower seal member 14 may include male shapes 60 of variable height along their mating surfaces 20 and 22, respectively. In a preferred embodiment, a single mating surface is designed to mate with itself. More specifically, a single profile section is produced, cut, and flipped over to mate with itself and form a seal, as illustrated in FIG. 18*c*. Here, the single profile serves as both the upper seal member 12 and the lower seal member 14.

Figure 19:
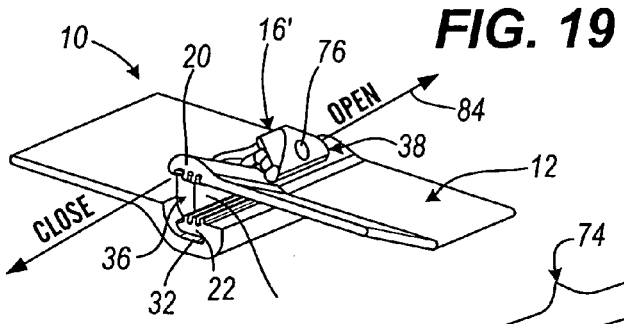
FIG. 19 is a perspective view of a modified sealing device of the first embodiment.
Figure 20:
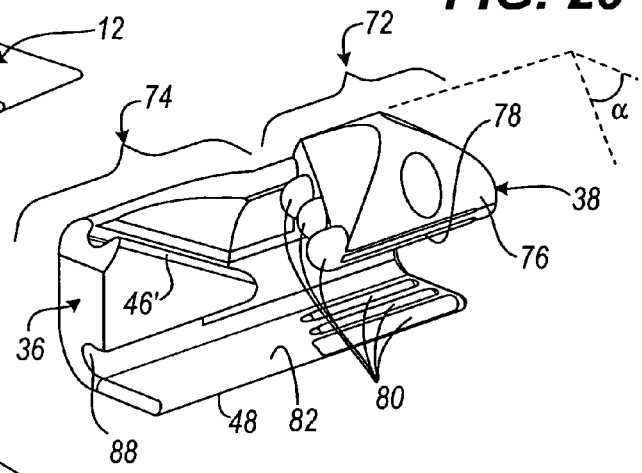
FIG. 20 is a perspective view of the modified slider shown in FIG. 19.

Referring now to FIGS. 19-20, a modification of the first embodiment is presented, wherein a modified slider 16' is used in combination with an upper seal member 12 and a lower seal member 14 to create a seal 17. Slider 16' features a closing portion 72 and an opening portion 74. As with slider 16, slider 16' is moved along the length of the seal 17 to either close or open the seal 17. In use, as slider 16' is moved along the seal profiles, the closing portion 72 closes the seal portion it passes. Conversely, when slider 16' is moved in the opposite direction, the opening portion 74 opens the seal portion it passes.

Closure of the seal 17 occurs at closing end 72 because upper seal member 12 is placed in confinement with lower seal member 14, thereby pressing mating surface 20 of upper seal member 12 into the mating surface 22 of lower seal member 14. More particularly, the mating surface 20 of upper seal member 12 is pressed into the mating surface 22 of lower seal member 14 by upper canted portion 76 of slider 16'. As this action occurs, lower seal member 14 is held in place by closure bar 48 of slider 16'.

Canted portion 76 may have a horizontal interior surface 78. However, canted portion 76 is preferably tilted, or set at a downward angle $\alpha$relative to a horizontal plane. This downward angle $\alpha$functions to rotate the upper seal member 12 as its mating surface 20 is pressed into mating surface 22 of lower seal member 14. This rotation of upper seal member 12 assists in allowing slider 16' to move more freely as it is used to zip the seal 17 closed or open. In addition, rotation of upper seal member 12 improves the air and water resisting characteristic of the seal in a closure state, by rotating the male shapes 60 into female shapes 62, thus improving the contact of their individual surfaces. Male shapes 60 and female shapes 62 used in conjunction with mating surfaces 20 and 22 that are sealed using slider 16' may contain notches 64, projections 66, additional shapes 68, simple shapes 70, as well as all other features previously described for mating surfaces 20, 22 and their component structures.

Referring now to FIG. 20, a series of partial cylindrical shapes 80 are provided for reducing friction between the upper canted portion 76 and the upper seal member 12. More specifically, the interior surface 78 of upper canted portion 76 preferably includes a series of partial cylindrical shapes 80 that contact the upper surface 47 of the main profile portion 25 of upper seal member 12. These cylindrical shapes 80 serve to reduce friction between the upper canted portion 76 and upper seal member 12 as upper seal member 12 contacts the upper canted portion 76. Partial cylindrical shapes 80 are also preferably used along at least a portion of closure bar 48 at the closure portion 72 of slider 16'. The cylindrical shapes 80 along the interior surface 82 of closure bar 48 reduce friction between the closure bar 48 and the lower seal member 14.

Slider 16' stabilizes and controls the position of lower seal member 14 using closure bar 48. The aspects of closure bar 48 used in conjunction with slider 16' encompass all of the permutations previously described. Without limitation, closure bar 48 may be relatively long, similar to that shown previously in FIG. 9*a*, or it may be very short and take on the appearance of a prong, as illustrated in FIG. 9*d*. It may also include an end shape 51 to assist in grabbing lower seal member 14. This is particularly useful if a relatively short or prong-shaped closure bar 48 is utilized. Regardless of its shape, as with slider 16, closure bar 48 functions to control the location of lower member 14 within slider 16'.

Referring again to FIGS. 19 and 20, opening portion 74 of slider 16' functions to separate upper seal member 12 from lower seal member 14 and open the seal 17. Opening portion 74 preferably includes one lifting rib 46'. Lifting rib 46' preferably extends in an inclined position from approximately the middle of slider 16' to the end of slider 16' at the opening portion 74 of the slider 16'. Opening portion 74 also includes closure bar 48, which preferably extends the entire length of the bottom of slider 16'. Closure bar 48 anchors the lower seal member 44 to the bottom of the slider 16'. As the slider 16' is moved in an opening direction in accordance with arrow 84 of FIG. 19, the combination of action of lifting rib 46' on upper seal member 12 and the closure bar 48 on lower seal member 14 pulls the two seal members 12 and 14 apart, thus opening the seal. The preferable use of one lifting rib 46' in slider 16' provides a rotation motion to the upper seal member 12 as it is separated from lower seal member 14. This rotation occurs because the side of the main profile portion 25 adjacent the lifting rib 46' is lifted before the side of the main profile portion 25 opposite the lifting rib 46'. The rotational feature provides for smoother separation of the upper seal member 12 from the lower seal member 14, and also tends to improve the longevity of seal performance because less friction is induced between the upper seal member 12 and lower seal member 14 during opening. Lifting rib 46' may be shaped like a rail, or it may be wedge shaped, as shown in FIG. 20.

Figure 21:
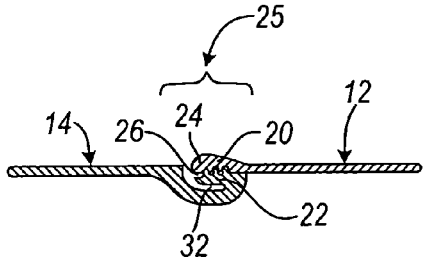
FIG. 21 is a cross-sectional view of one possible seal profile that may be used in conjunction with the slider shown in FIG. 20.

Referring now to FIG. 21, an example of a seal 17 comprising upper seal member 12 and lower seal member 14 is shown. Lifting groove 26 is formed under lifting wing 24 at the edge of the main profile portion 25 of upper seal member 12. Lifting groove 26 receivingly accepts lifting rib 46' of slider 16'. FIG. 21 also illustrates closure bar groove 32 within lower seal member 14.

The various seal configurations depicted in FIGS. 9*a* through 9*o*are applicable to use with slider 16'. More specifically, in addition to the features already discussed, such as closure bar 48 characteristics and profile mating surfaces 20, 22, slider 16' may utilize alternate configurations and features than are shown in FIG. 21. For example, slider 16' may incorporate a single top mounted lifting rib (see FIG. 9*i*), or a side and top mounted lifting rib (see FIG. 9*j*). Portions of upper seal member 12 beyond the main profile portion 25 may be at the same elevation or a different elevation than lower seal member 14. Stiffener inserts 54 may also be used in lower seal member 14 when using slider 16'.

Figure 22:
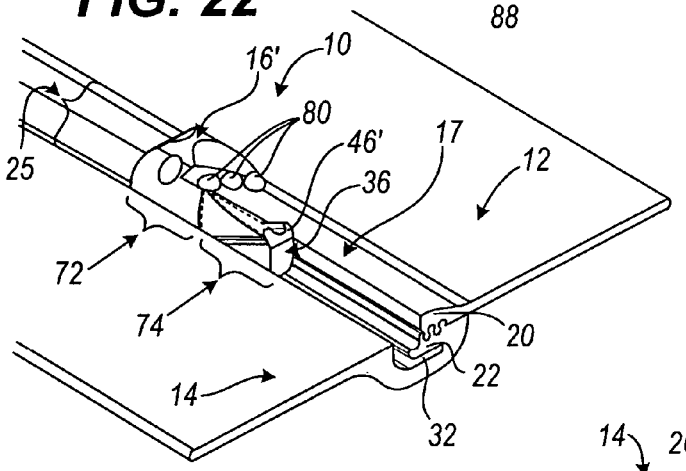
FIG. 22 is a perspective view of the modified sealing device of FIG. 19 where the slider is in the vicinity of the end of the seal profiles.
Figure 23:
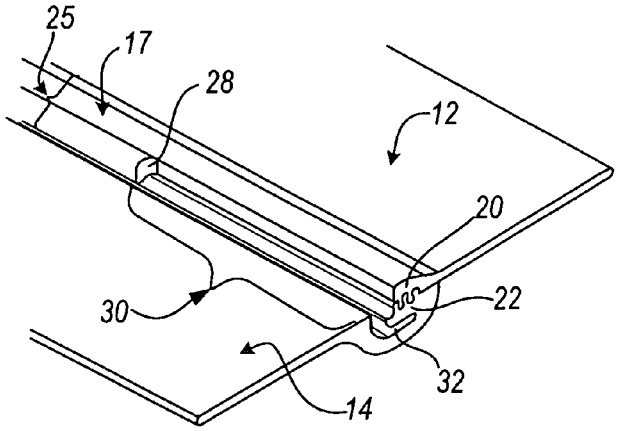
FIG. 23 is a perspective view of the end of the seal profiles showing the cut lifting wing.

Referring now to FIGS. 22 and 23, lifting rib 46' is prevented from separating upper seal member 12 from lower seal member 14 by cutting and removing the lifting wing 24 from the upper seal member 12 at the end portion of 30 of seal 17.

Since lifting wing 24 is absent, the opening portion 74 of slider 16' is unable to grasp the underside of upper seal member 12 and cause it to separate from lower seal member 14. This aspect of the invention enables a seal 17 to be formed upon closure, because the entire length of the upper seal member 12 creates a fluid barrier with lower seal member 14.

Figure 24:
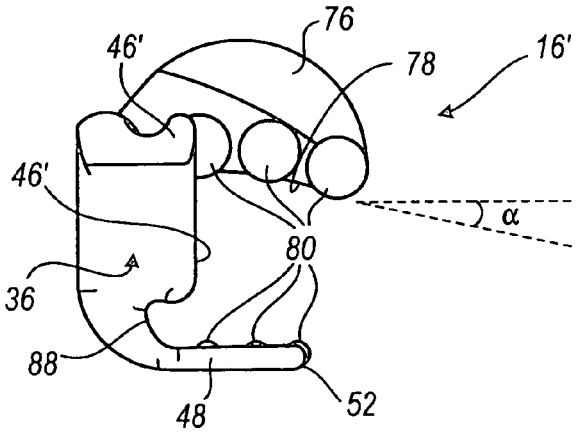
FIG. 24 is an elevation view of the modified slider of FIG. 20 looking toward the opening portion of the slider.

FIG. 24 provides an elevation view of slider 16' looking toward the front or opening portion 74 the slider 16'. This view further illustrates lifting rib 46' rising in the foreground on an angle from the middle of slider 16' to the front end of slider 16'. Preferably, a groove 88 is formed in slider 16' to assist in retaining lower seal member 14 during opening of the seal 17.

Figure 25:
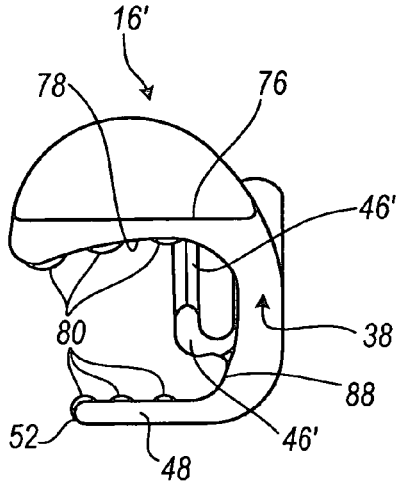
FIG. 25 is an elevation view of the modified slider of FIG. 20 looking toward the closing portion of the slider.

Referring now to FIG. 25, a rear elevation view of slider 16' is provided. This view depicts the slider 16' looking toward the closing portion 72. Again, lifting rib 46' is shown rising toward the top of slider 16'.

Figure 26:
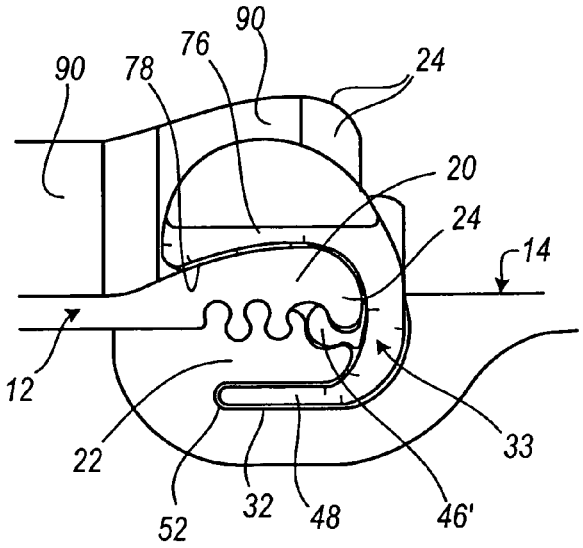
FIG. 26 is an elevation view of the modified slider of FIG. 20 with upper and lower seal profiles looking toward the closing portion of the slider.

FIG. 26 depicts a the same rear elevation view as shown in FIG. 25, but with an upper seal member 12 and a lower seal member 14 disposed within the slider 16'. This view also depicts lifting wing 24 of upper seal member 12 disposed over lifting rib 46'. Closure bar 48 anchors lower seal member 14 within slider 16', and also provides confinement in conjunction with canted portion 76 at the closing end 38 of slider 16' to press mating surface 20 of upper seal member 12 into interlocking position with mating surface 22 of lower seal member 14. A top surface 90 of upper seal member 12 is shown rising in the background of the slider 16' as the upper seal member 12 is forced open at the front end of the slider.

Figure 27:
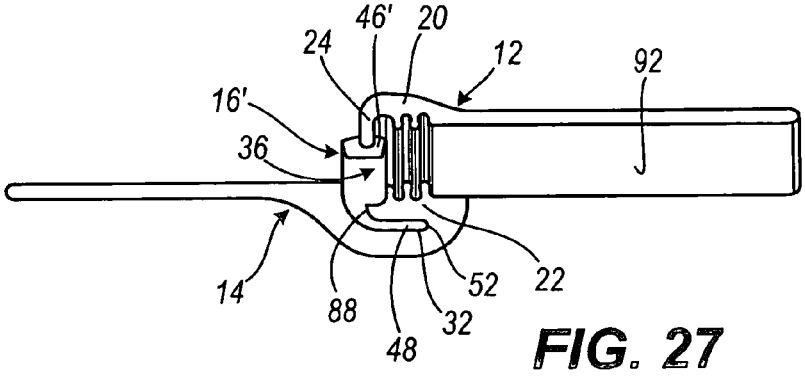
FIG. 27 is an elevation view of the modified slider of FIG. 20 with upper and lower seal profiles looking toward the opening portion of the slider.

In contrast to FIG. 26, a front elevation view of slider 16' with upper seal member 12 and lower seal member 14 is shown in FIG. 27. Here, the function of the opening portion 74 of slider 16' is illustrated. Upper seal member 12 has been pulled apart from lower seal member 14 at the opening end 36 of slider 16', thereby exposing the bottom surface 92 of upper seal member 12.

In a further embodiment, the present invention includes a device for sealing a first edge of a first surface of an object with a second edge of a second surface of the object where the first edge is oriented substantially parallel to the second edge, the first and second surfaces are substantially coplanar, and the first surface extends in a direction opposite the second surface. The device includes an upper seal member, a lower seal member, a slider and a plug. The upper seal member is attached to the first edge and has a first mating surface. The lower seal member is attached to the second edge and has a second mating surface. The second mating surface and the first mating surface are releasably interlockable. The slider has a body, a slider interior structure and an exterior tongue and groove portion. The body includes an opening end and a closing end, with the closing end having a confining portion in which the first mating surface of the upper seal member is placed into interlocking contact with the second mating surface of the lower seal member. The slider interior structure cooperates with the first mating surface of the upper seal member, and cooperates with the second mating surface of the lower seal member. The plug has a plug interior structure, and an exterior tongue and groove portion. The plug interior structure cooperates with the first mating surface of the upper seal member, and cooperates with the second mating surface of the lower seal member. In a closing position, the plug interior structure interlocks with the slider interior structure, and the exterior tongue and groove portion of the plug interlocks with the slider tongue and groove portion. When the slider is moved in a direction causing the upper seal member and the lower seal member to pass within the slider from the opening end to the closing end, the slider confines the first mating surface into contact with the second mating surface thereby creating a seal.

FIGS. 28-31 illustrate this embodiment of the seal device 100. Seal device 100 includes an upper seal member 12, a lower seal member 14, a slider 102 and a plug 104. Slider 102 includes a pull tab 40, pin 42 and pull tab track 44. It is an aspect of this embodiment to provide sealing device 100 that may be locked. Accordingly, pull tab 40 preferably includes an aperture 106 that receivingly accepts lock receptacle 108 of plug 104 when the slider 102 is in its closed position. More specifically, plug 104 is a permanent stop that is affixed to the end of seal 17. To close seal 17, slider 102 is zipped down the sealing profile 17 of upper seal member 12 and lower seal member 14, thereby interlocking mating surface 20 of upper seal member 12 with mating surface 22 of lower seal member 14. Slider 102 is then brought into to its mating closure position 110 with plug 104, as will be discussed in detail below. Pull tab 40 is then secured with lock receptacle 108 of plug 104 by placing pull tab 40 in a forward position such that lock receptacle 108 passes through aperture 106 of pull tab 40. Lock receptacle 108 includes a hole 112 that is sized to receive a common travel lock (not shown).

Figure 28:
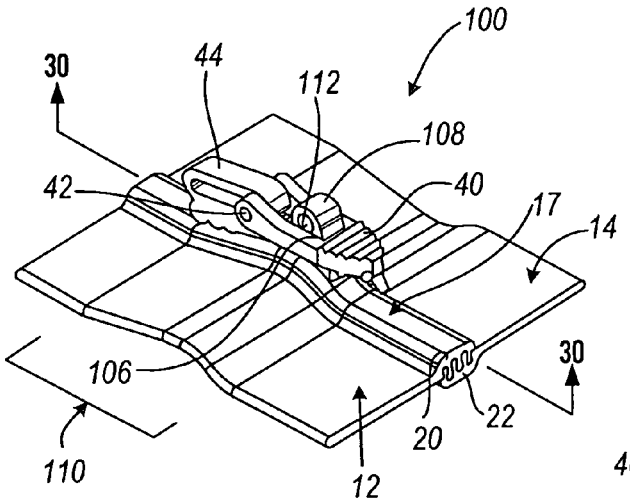
FIG. 28 is a perspective view of a second embodiment of the present invention.
Figure 29:
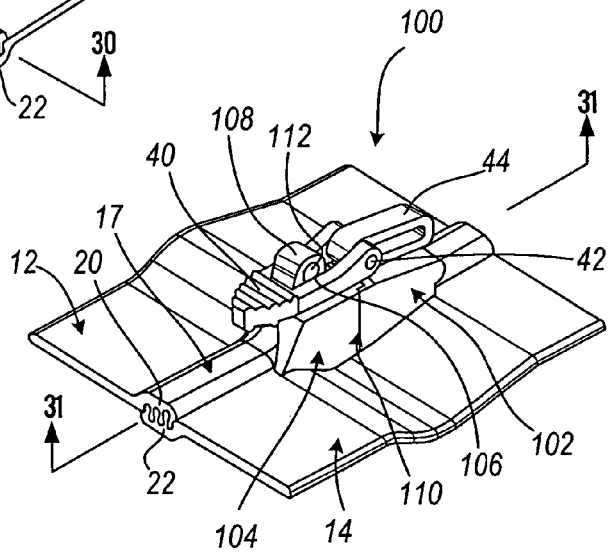
FIG. 29 is an alternate perspective view of the second embodiment of the present invention.

Referring again to FIGS. 28 and 29, two perspective views of seal 100 are shown. FIGS. 28 and 29 depict slider 102 in its closure position 110 with plug 104, whereby slider 102 and plug 104 make a seal 17 at the end of the seal profile 110.

Figure 30:
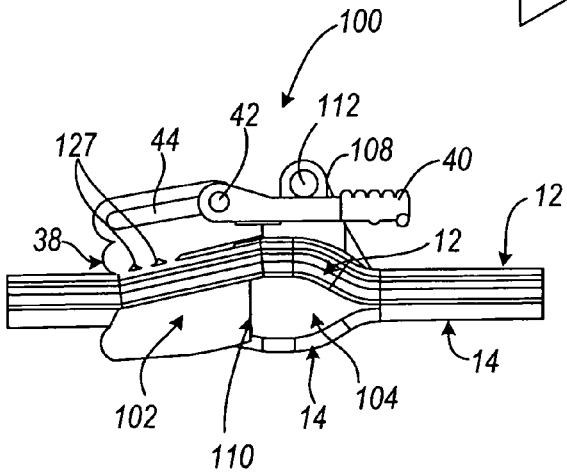
FIG. 30 is a cross sectional view taken along line 30-30 of FIG. 28.

FIG. 30 is a cross-sectional view of seal device 100 taken at the side of upper seal member 12 along line 30-30 of FIG. 28. FIG. 30 illustrates the disposition of upper seal member 12 and lower seal member 14 when slider 102 is in its closure position 110 with plug 104. Here, upper seal member 12 and lower seal member 14 are shown separated within the zone occupied by the slider 102 and plug 104. Here, upper seal member 12 and lower seal member 14 form a hydraulic and vapor barrier with the interior structure of slider 102 and plug 104, as will be discussed below.

Figure 31:
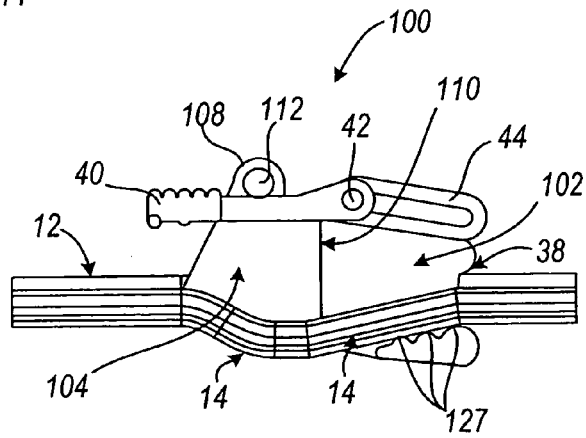
FIG. 31 is a cross sectional view taken along line 31-31 of FIG. 29.

FIG. 31 is a cross-sectional view of seal device 100 taken at the side of lower seal member 14 along line 31-31 of FIG. 29. That is, FIG. 31 illustrates the opposite side of slider 102/plug 104 coupling as compared to the cross section depicted in FIG. 30. In FIG. 31, lower seal member 14 is shown separated from upper seal member 12 in the zone occupied by the slider 102 and plug 104.

Referring now to FIG. 32, the exterior and interior mating structure of plug 104 and slider 102 are shown. More specifically, plug 104 includes exterior tongue and groove portion 114, that couples with exterior tongue and groove portion 116 of slider 102 when the slider 102 and plug 104 are set in their closure position 110. That is, slider 102 and plug 104 are interlocked by inserting slider 102 with plug 104 in accordance with arrows A. Furthermore, the interior structure 118 of plug 104 is shaped to cooperate and interlock with the mating surface 20 of upper seal member 12 and lower seal member 14. Likewise, the interior structure 120 of slider 102 is shaped to cooperate and interlock with the mating surface 22 of lower seal member 104. In addition, the interior structure 118 of plug 104 interlocks with the interior structure 120 of slider 102. A seal is formed when slider 102 and plug 104 are in their closure position 110, because (1) mating surface 20 of upper seal member 12 forms a hydraulic seal with top portion 122 of interior structure 118 of plug 104, and also forms a hydraulic seal with the top portion 124 of the interior structure 120 of slider 102, and (2) because the mating surface 22 of lower seal member 14 forms a hydraulic seal with the bottom portion 126 of interior structure 118 of plug 104, and also forms a hydraulic seal with the bottom portion 128 of the interior structure 120 of slider 102.

Referring to FIGS. 31-32 closure bumps 127 are provided for reducing friction with upper seal member 12 and lower seal member 14. More particularly, closure bumps 127 are preferably cylindrical shaped and reduce friction between slider 102 and upper seal member 12 and lower seal member 14 when slider 102 is moved down the length of seal 17, because seal members 12 and 14 only touch the closure bumps tangentially as the slider 102 is moved.

Referring now to FIG. 33, a top plan view of slider 102 and plug 104 is shown. This view illustrates the exterior tongue and groove portion 114 of plug 104, that couples with exterior tongue and groove portion 116 of slider 102 when slider 102 is placed in its closure position 110 with plug 104.

Referring now to FIG. 34, the interior structure 120 of slider 102 is shown in a front elevation view. This view illustrates that the interior structure 120 of slider 102 is formed to interlock with the mating surfaces 20 and 22 of upper seal member 12 and lower seal member 14, respectively. Furthermore, individual struts 130 of interior structure 120 are situated at an angle θ, that permits a male portion of a strut 130 to intercept a female shape 62 of mating surface 20 of upper seal member 12 and a female portion 62 of mating surface 22 of lower seal member 14. This aspect of the invention provides increased stability and strength to the interior structure 120 of slider 102.

Preferably, seal 100 is used in conjunction with a variable height profile mating shape. That is, preferably, the male shapes 60 and female shapes 62 of the mating surfaces 20 and 22 of the upper seal member 12 and lower seal member 14 are set at different heights. For example, the mating profile shape shown in FIG. 18*c* is a preferred profile to use with sealing device 100 to aid in water and air resistance as the upper seal member 12 and lower seal member 14 are closed together at the closing end 38 of slider 102.

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

While the above description and the drawings disclose and illustrate numerous alternative embodiments, one should understand, of course, that the invention is not limited to these embodiments. Those skilled in the art to which the invention pertains may make other modifications and other embodiments employing the principles of this invention, particularly upon considering the foregoing teachings. Therefore, by the appended claims, the applicant intends to cover any modifications and other embodiments.

What is claimed is:

1. A seal for use in conjunction with a slider, comprising:

(a) an upper seal member comprising a first mating surface and a first width $W_1$ of runout material, the upper seal member comprising a start, a middle and an end portion, and a lifting wing on said middle portion and not on said end portion; and (b) a lower seal member comprising a second mating surface and a second width $W_2$ of runout material, the second mating surface having a shape that interlocks with said first mating surface, the lower seal member further comprising a closure bar groove;

wherein said first and second mating surfaces interlock, wherein said lifting wing is accessible for interaction with a slider lifting rib, wherein said closure bar groove is accessible for interaction with a slider closure bar, wherein when separating the first and second mating surfaces the closure bar of the slider anchors the lower seal member and the lifting rib of the slider contacts the lifting wing of the upper seal member to pull and separate the first mating surface from the second mating surface as the slider is moved in an opening direction, and wherein the first width $W_1$ of runout material of the upper seal member does not overlap the second width $W_2$ of runout material of the lower seal member when the first and second mating surfaces interlock.

2. A product, comprising the seal, as claimed in claim 1, wherein said product is selected from the group consisting of hazardous material suits, fire suits, dry suits, dry bags, bivy sacks, waders, space suits, tents, shipping packages, household storage bags, map cases, chart cases, kayak skirts, backpack covers, computer cases, electronic device cases, watercraft containers, inflatable cases, flotation bags, flotation devices, waterproof pockets, fishing vest pockets, smell-proof pockets, wetsuits, jackets, sleeping bags, rain gear, boots, kayak jackets, wind breakers, and wind proof fleeces.

3. A seal for use as a closure device, comprising:

(a) a slider comprising a lifting rib and a closure bar;

(b) an upper seal member comprising a first mating surface and a first width $W_1$ of runout material, the upper seal member comprising a start, a middle and an end portion, and a lifting wing on said middle portion and not on said end portion; and (c) a lower seal member comprising a second mating surface and a second width W2 of runout material, the second mating surface having a shape that interlocks with said first mating surface, the lower seal member further comprising a closure bar groove;

wherein said first and second mating surfaces interlock, wherein said lifting wing is accessible for interaction with the lifting rib of the slider, wherein said closure bar groove is accessible for interaction with the closure bar of the slider, wherein when separating the first and second mating surfaces the closure bar of the slider anchors the lower seal member and the lifting rib of the slider contacts the lifting wing of the upper seal member to pull and separate the first mating surface from the second mating surface as the slider is moved in an opening direction, and wherein the first width $W_1$ of runout material of the upper seal member does not overlap the second width $W_2$ of runout material of the lower seal member when the first and second mating surfaces interlock.

4. A product, comprising the seal, as claimed in claim 3, wherein said product is selected from the group consisting of hazardous material suits, fire suits, dry suits, dry bags, bivy sacks, waders, space suits, tents, shipping packages, household storage bags, map cases, chart cases, kayak skirts, backpack covers, computer cases, electronic device cases, watercraft containers, inflatable cases, flotation bags, flotation devices, waterproof pockets, fishing vest pockets, smell-proof pockets, wetsuits, jackets, sleeping bags, rain gear, boots, kayak jackets, wind breakers, and wind proof fleeces.

* * * * *